US011458593B2

(12) United States Patent
Ito et al.

(10) Patent No.: US 11,458,593 B2
(45) Date of Patent: Oct. 4, 2022

(54) HIGH-POROSITY CBN VITRIFIED GRINDING STONE HAVING HOMOGENEOUS STRUCTURE

(71) Applicant: NORITAKE CO., LIMITED, Nagoya (JP)

(72) Inventors: Ryoma Ito, Nagoya (JP); Takeshi Mishima, Nagoya (JP); Kouichi Yoshimura, Nagoya (JP)

(73) Assignee: NORITAKE CO., LIMITED, Nagoya (JP)

( * ) Notice: Subject to any disclaimer, the term of this patent is extended or adjusted under 35 U.S.C. 154(b) by 0 days.

(21) Appl. No.: 17/045,511

(22) PCT Filed: Mar. 6, 2019

(86) PCT No.: PCT/JP2019/008887

§ 371 (c)(1),
(2) Date: Oct. 6, 2020

(87) PCT Pub. No.: WO2019/193908

PCT Pub. Date: Oct. 10, 2019

(65) Prior Publication Data

US 2021/0162564 A1 Jun. 3, 2021

(30) Foreign Application Priority Data

Apr. 6, 2018 (JP) ..... JP2018-074259

(51) Int. Cl.
*B24D 3/18* (2006.01)
*B24D 3/14* (2006.01)
(Continued)

(52) U.S. Cl.
CPC ..... *B24D 3/18* (2013.01); *B24D 3/14* (2013.01); *B24D 5/06* (2013.01); *B24D 18/0009* (2013.01)

(58) Field of Classification Search
CPC ... B24D 3/14; B24D 3/18; B24D 5/06; B24D 18/0009
See application file for complete search history.

(56) References Cited

U.S. PATENT DOCUMENTS 5,095,665 A * 3/1992 Nagata ..... B24D 3/346 51/307
6,500,220 B1 * 12/2002 Krueger ..... B24D 3/348 51/306
2010/0154315 A1 * 6/2010 Wu ..... B24D 3/18 51/296

FOREIGN PATENT DOCUMENTS

JP 2009-072835 A 4/2009
JP 5192763 B2 5/2013
(Continued)

OTHER PUBLICATIONS

May 7, 2019 Written Opinion issued in International Patent Application No. PCT/JP2019/008887.
(Continued)

*Primary Examiner* — Pegah Parvini
(74) *Attorney, Agent, or Firm* — Oliff PLC

(57) ABSTRACT

In a high-porosity CBN vitrified grinding stone having a homogeneous structure, a CBN abrasive grain, a large-diameter inorganic hollow filler having an average particle diameter in a range from a grain size one class coarser to a grain size one class finer with respect to a class indicating a grain size of the CBN abrasive grain, and a small-diameter inorganic hollow filler having an average particle diameter of ⅕ to ½ of that of the CBN abrasive grain are bonded by an inorganic bonding agent.

4 Claims, 5 Drawing Sheets

(51) Int. Cl.
*B24D 18/00* (2006.01)
*B24D 5/06* (2006.01)

(56) References Cited

FOREIGN PATENT DOCUMENTS

| | | |
|---|---|---|
| JP | 2014-083621 A | 5/2014 |
| JP | 2017-170554 A | 9/2017 |

OTHER PUBLICATIONS

May 7, 2019 International Search Report issued in International Patent Application No. PCT/JP2019/008887.
May 21, 2019 Office Action issued in Japanese Patent Application No. 2018-074259.
Jun. 23, 2022 Office Action issued in Chinese Patent Application No. 201980024617.8.

* cited by examiner

FIG.5

| | | |
|---|---|---|
| WORKPIECE MATERIAL | SKD-11 | |
| WORKPIECE SIZE | 100L × 10W | |
| GRINDING CONDITIONS | WHEEL PERIPHERY SPEED | 1800m/min |
| | PROCESSING METHOD | CREEP FEED |
| | TABLE SPEED | 300mm/min |
| | DEPTH OF CUT | 0.2mm/pass 10cut |
| GRINDING FLUID | SEC700 50-FOLD DILUTION | |

FIG.6

| | COMPARATIVE EXAMPLE PRODUCT 1 | COMPARATIVE EXAMPLE PRODUCT 2 | EXAMPLE PRODUCT 1 | EXAMPLE PRODUCT 2 | EXAMPLE PRODUCT 3 | EXAMPLE PRODUCT 4 |
|---|---|---|---|---|---|---|
| POWER CONSUMPTION | 0.535 kW | 0.448 kW | 0.517 kW | 0.512 kW | 0.522 kW | 0.528 kW |
| WHEEL CORNER SAGGING CROSS-SECTIONAL AREA | $64 \times 10^{-4}$ $mm^2$ | $64 \times 10^{-4}$ $mm^2$ | $32 \times 10^{-4}$ $mm^2$ | $39 \times 10^{-4}$ $mm^2$ | $38 \times 10^{-4}$ $mm^2$ | $32 \times 10^{-4}$ $mm^2$ |
| DEPTH OF CUT WHERE GRINDING BURN OCCURS | 0.44 mm | 0.70 mm | 0.75 mm | 0.70 mm | 0.72 mm | 0.65 mm |

HIGH-POROSITY CBN VITRIFIED GRINDING STONE HAVING HOMOGENEOUS STRUCTURE

TECHNICAL FIELD

The present invention relates to a high-porosity vitrified CBN grinding stone having a homogeneous structure suitably applied to a field where grinding load is high and grinding burn is likely to occur on a workpiece.

BACKGROUND ART

In general, a high-porosity CBN vitrified grinding stone is known as a grinding stone suitably applied to the field where grinding load is high and grinding burn is likely to occur on a workpiece, such as internal grinding and angular grinding. For example, a high-porosity CBN vitrified grinding stone described in Patent Literature 1 is such a type. This high-porosity CBN vitrified grinding stone is manufactured using a hollow filler having a single particle size at a fixed filling volume. According to this high-porosity CBN vitrified grinding stone, pores are artificially formed by the hollow filler to have a high porosity, and as a result, the grinding heat is easily released in grinding under a grinding fluid, and grinding burn on the workpiece is suitably suppressed.

CITATION LIST

Patent Document

Patent Literature 1: Publication of Japanese Patent No. 5192763

SUMMARY OF INVENTION

Technical Problem

However, in the foregoing conventional high-porosity CBN vitrified grinding stone, agglomeration of the hollow filler contained therein causes abrasive grains to locally drop off, and the filling volume is small and sufficient bond is not provided around the abrasive grains and the hollow filler, so that there is a disadvantage that a favorable grinding stone life cannot be ensured. Correspondingly, a CBN vitrified grinding stone in which the agglomeration of the hollow filler is suppressed has been proposed. However, the filling volume of the hollow filler is small and the problem of ensuring the grinding stone life is still unsolved.

The present invention has been made in view of the foregoing circumstances, and the object thereof is to provide a high-porosity CBN vitrified grinding stone capable of ensuring the grinding stone life by filling an appropriate amount of a hollow filler having an appropriate particle diameter and increasing the strength of the grinding stone without changing the content of an inorganic bonding agent.

The present inventors carried out various studies on the kind and amount of the hollow filler regarding the suppression of local drop of abrasive grains of such a high-porosity CBN vitrified grinding stone that the percentage of abrasive grains falls below, for example, 40% by volume, and in work material burn, and as a result, found the fact that when a hollow filler having a diameter equal to that of abrasive grains and a hollow filler having a diameter sufficiently smaller than that of the abrasive grains are used while the high porosity is maintained, the local drop of the abrasive grains and the work material burn are suitably suppressed.

The present invention has been made based on this finding. It is presumed that because the small-diameter hollow filler is interposed between the abrasive grains and the hollow filler having a diameter equal to that of the abrasive grains, the dispersion of the abrasive grains and the hollow filler having a diameter equal to that of the abrasive grains is accelerated and a homogeneous structure is obtained, so that the local drop of the abrasive grains and the work material burn are suitably suppressed.

Solution to Problem

To achieve the above object, a first aspect of a high-porosity CBN vitrified grinding stone having a homogeneous structure provides that a CBN abrasive grain, a large-diameter inorganic hollow filler having an average particle diameter in a range from a grain size one class coarser to a grain size one class finer with respect to a class indicating a grain size of the CBN abrasive grain, and a small-diameter inorganic hollow filler having an average particle diameter of ⅕ to ½ of that of the CBN abrasive grain are bonded by an inorganic bonding agent.

A second aspect of the present invention provides the high-porosity CBN vitrified grinding stone having a homogeneous structure recited in the first aspect of the invention, wherein a total filling volume of the CBN abrasive grain, the inorganic bonding agent, the large-diameter inorganic hollow filler, and the small-diameter inorganic hollow filler is 75 to 90 parts by volume when the high-porosity CBN vitrified grinding stone is 100 parts by volume.

A third aspect of the present invention provides the high-porosity CBN vitrified grinding stone having a homogeneous structure recited in the first or second aspect of the invention, wherein a volume ratio between the large-diameter inorganic hollow filler and the small-diameter inorganic hollow filler is in a range of 5:5 to 7:3.

A fourth aspect of the present invention provides the high-porosity CBN vitrified grinding stone having a homogeneous structure recited in any one of the first to third aspects of the invention, wherein homogeneity having a standard deviation of 8.5 or less in a frequency distribution chart of an abrasive grain area ratio which is a distribution chart of proportions of a solid matter including the CBN abrasive grain per unit area at a plurality of locations in a cross section of the grinding stone is provided.

Advantageous Effects of Invention

According to the high-porosity CBN vitrified grinding stone having a homogeneous structure in the first aspect of the invention, the CBN abrasive grain, the large-diameter inorganic hollow filler having the average particle diameter in the range from the grain size one class coarser to a grain size one class finer with respect to a class indicating the grain size of the CBN abrasive grain, and the small-diameter inorganic hollow filler having the average particle diameter of ⅕ to ½ of that of the CBN abrasive grain are bonded by the inorganic bonding agent. Thus, the small-diameter inorganic hollow filler having the average particle diameter of ⅕ to ½ of that of the CBN abrasive grains is interposed between the CBN abrasive grains and the large-diameter inorganic hollow filler, whereby the homogeneous grinding stone structure in which the CBN abrasive grains and the large-diameter inorganic hollow filler are uniformly dispersed is obtained. As a result, the distance between the CBN abrasive grains becomes uniform, and local drop of the abrasive grains and work material burn are suitably suppressed even if the porosity is high, that is, the abrasive grain percentage is low. Further, the grinding stone strength and the grinding stone life can be obtained due to the homogeneous structure.

According to the high-porosity CBN vitrified grinding stone having a homogeneous structure in the second aspect of the invention, the total filling volume of the CBN abrasive grain, the inorganic bonding agent, the large-diameter inorganic hollow filler, and the small-diameter inorganic hollow filler is 75 to 90 parts by volume when the high-porosity CBN vitrified grinding stone is 100 parts by volume. As a result, the grinding stone strength is further enhanced.

According to the high-porosity CBN vitrified grinding stone having a homogeneous structure in the third aspect of the invention, the volume ratio between the large-diameter inorganic hollow filler and the small-diameter inorganic hollow filler is in the range of 5:5 to 7:3. As a result, the CBN abrasive grains and the large-diameter inorganic hollow filler can be more uniformly dispersed.

According to the high-porosity CBN vitrified grinding stone having a homogeneous structure in the fourth aspect of the invention, the homogeneity having the standard deviation of 8.5 or less in the frequency distribution chart of the abrasive grain area ratio, which is the distribution chart of proportions of the solid matter including the CBN abrasive grain per unit area at a plurality of locations in the cross section of the grinding stone is provided. As a result, a high-porosity CBN vitrified grinding stone having a homogeneous grinding stone structure can be obtained.

Here, regarding the small-diameter inorganic hollow filler, when the CBN abrasive grains and the large-diameter inorganic hollow filler having the same particle diameter as the CBN abrasive grains or a grain size up to one class (one grain size class) coarser or one class (one grain size class) finer than the CBN abrasive grains are uniformly arranged, the particle size exactly and homogeneously entering into voids among them is particles having an average particle diameter of ⅕ to ½ of the average grain diameter of the CBN abrasive grains. Therefore, as the small-diameter inorganic hollow filler of the first aspect of the present invention, one having an average particle diameter of ⅕ to ½ of the average grain diameter of the CBN abrasive grains is selected.

In general, the life of the CBN vitrified grinding stone largely depends on the amount of an inorganic bonding agent (vitrified bond) provided around the CBN abrasive grains and the inorganic hollow filler. Even if the inorganic bonding agent has the same filling volume, a sufficient vitrified bond is not supplied to the CBN abrasive grains and the inorganic hollow filler when the amounts of CBN abrasive grains and inorganic hollow filler are small, and the life of the vitrified grinding stone tends to be shortened. When the filling volume of CBN abrasive grains is increased, the concentration is increased, and the life of the vitrified grinding stone can be expected to be improved. However, the possibility of occurrence of problems such as grinding burn is increased.

Accordingly, as shown in the second aspect of the present invention, in the high-porosity CBN vitrified grinding stone, the total filling volume of the CBN abrasive grains, the inorganic bonding agent, the large-diameter inorganic hollow filler, and the small-diameter inorganic hollow filler is set to 75 to 90% by volume. In this high-porosity CBN vitrified grinding stone, the filling volumes of the CBN abrasive grains and the inorganic bonding agent are set to be equal to those in the conventional vitrified grinding stone, and the amount of the inorganic hollow filler is increased more than that of the conventional vitrified grinding stone, and as a result, favorable sharpness and improvement in the grinding stone life can be expected. In the high-porosity CBN vitrified grinding stone of the second aspect of the present invention, the reason why the total filling volume of the CBN abrasive grains, the inorganic bonding agent, the large-diameter inorganic hollow filler, and the small-diameter inorganic hollow filler is set to 75 to 90% by volume is that manufacturing stability is taken into consideration. When the total filling volume exceeds 90% by volume, the inorganic hollow fillers cannot hold appropriate shapes.

BRIEF DESCRIPTION OF DRAWINGS

FIG. 5 is a chart showing conditions of grinding tests conducted to confirm the effect of using two kinds of large-diameter inorganic hollow filler and small-diameter inorganic hollow filler having different diameters as the hollow inorganic filler in the segment grinding stones of FIG. 1.

FIG. 6 is a chart showing results of the grinding tests conducted using the conditions of the grinding tests of FIG. 6 for Example products 1 to 4 corresponding to the vitrified grinding stone of FIG. 1 and Comparative Example product 1 and Comparative Example product 2.

DESCRIPTION OF EMBODIMENT

In a mode for carrying out the present invention, the inorganic hollow fillers are composed of, for example, silica, alumina, artificial glass, natural glass such as shirasu and perlite, zirconia, etc., and particularly, obsidian perlite, a shirasu balloon, an alumina balloon, or a glass balloon is preferably used.

Embodiment

Hereinafter, an embodiment of the present invention will be described in detail with reference to the drawings. The drawings are simplified or conceptualized as appropriate in the following embodiment, and the dimensional ratios and shapes of each portion are not necessarily drawn accurately.

Figure 1:
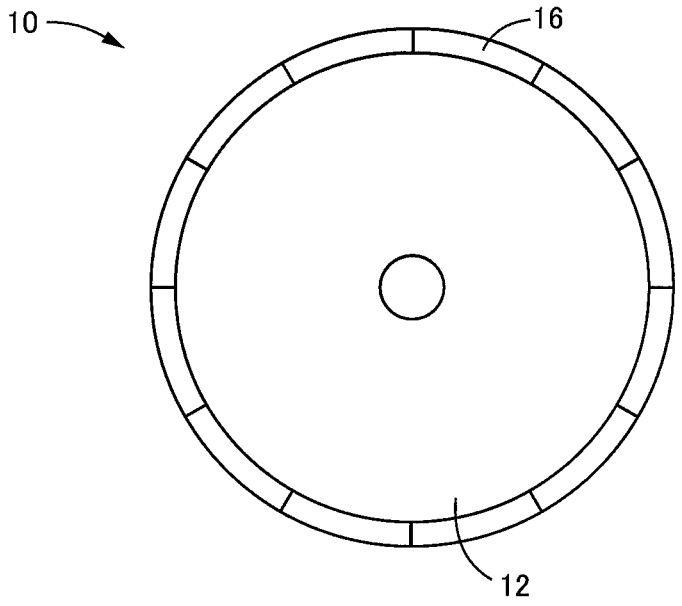
FIG. 1 is a drawing showing a high-porosity CBN vitrified grinding stone having a homogeneous structure according to an embodiment of the present invention.

FIG. 1 shows a vitrified grinding stone 10 for surface grinding, which is a high-porosity CBN vitrified grinding stone having a homogeneous structure according to an embodiment of the present invention. The vitrified grinding stone 10 includes a metal disc-shaped base metal 12 and a plurality of segment grinding stones 16 constituting an outer circumferential grinding surface by being fixed on an outer circumferential surface of the base metal 12.

Figure 2:
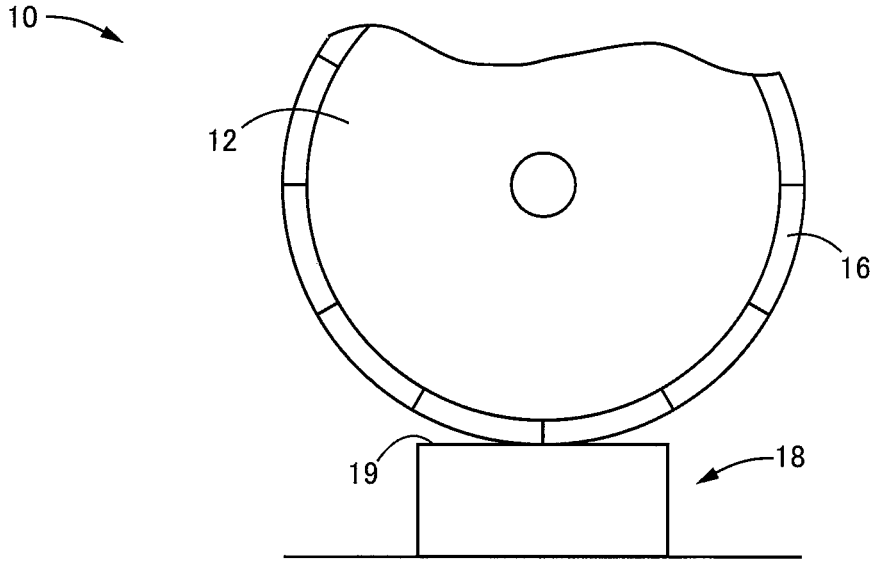
FIG. 2 is a drawing for explaining a grinding example by a grinding device using the CBN vitrified grinding stone of FIG. 1.

As shown in FIG. 2, when grinding a surface 19 of a steel work material 18 such as a crank journal portion or a camshaft front portion, the outer circumferential grinding surface of the vitrified grinding stone 10 is pressed against the surface 19 of the work material 18 with the work material 18 and the vitrified grinding stone 10 rotating, and then the surface 19 is ground.

Figure 3:
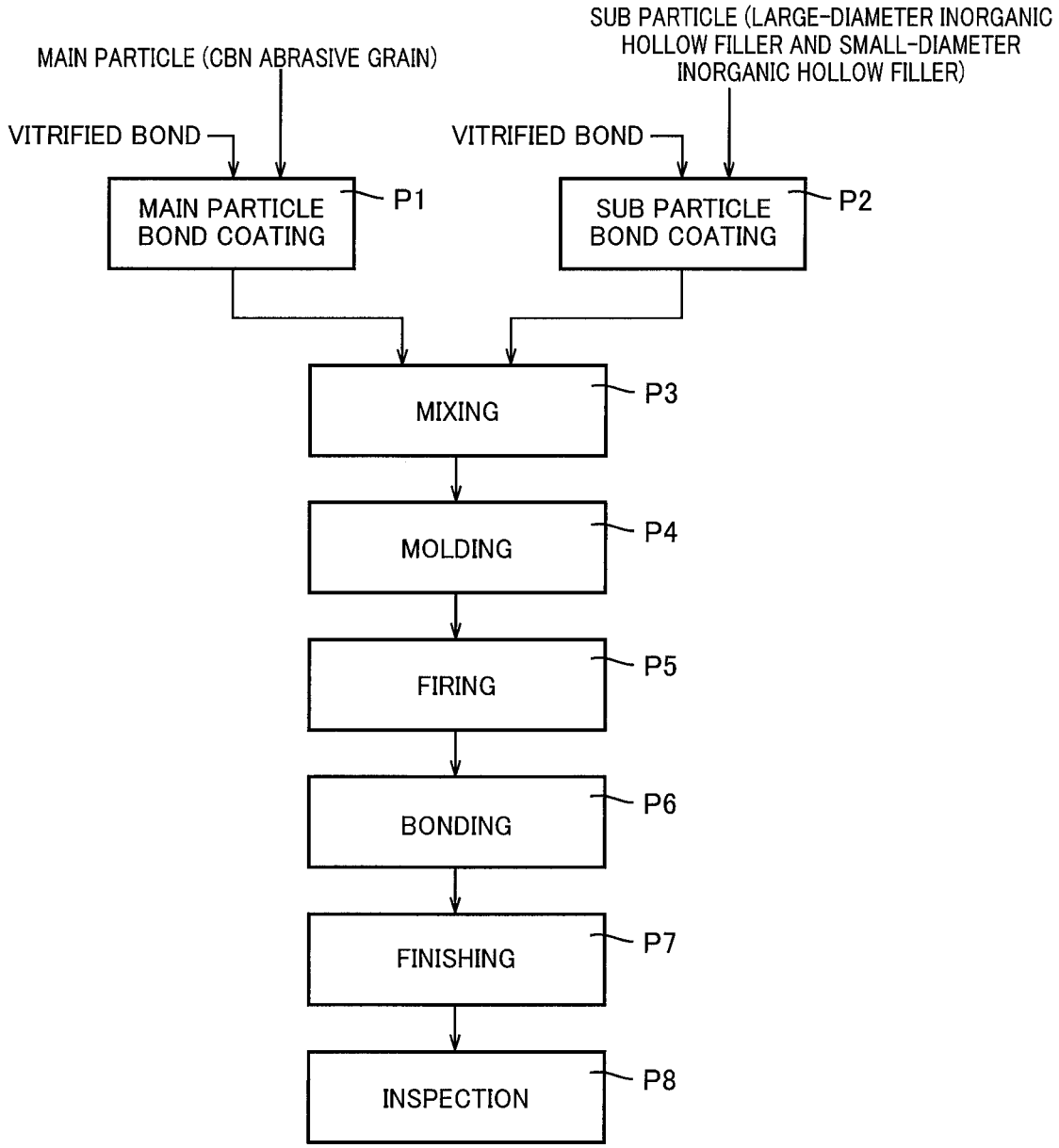
FIG. 3 is a process chart for explaining a main part of a method for manufacturing the CBN vitrified grinding stone of FIG. 1.

The segment grinding stones 16 of the vitrified grinding stone 10 are manufactured according to a process chart shown in FIG. 3, for example.

That is, first, in a main particle bond coating process P1, CBN abrasive grains 20 and a powder vitrified bond which is a glass powder fritted after melting and being excellent in high impact resistance and heat resistance and has an average particle diameter of 1/10 or less of the CBN abrasive grains 20 are mixed together with a well-known binding agent (molding aid) such as a synthetic adhesive paste represented by dextrin. As a result, a coating composed of the vitrified bond (inorganic bonding agent) 24 and the binding agent is formed on an outer surface of the CBN abrasive grain 20 in a layered form and is dried according to need, whereby further fluidity is given.

Further, in a sub particle bond coating process P2 as well, two kinds of large-diameter inorganic hollow filler 22 and small-diameter inorganic hollow filler 23 composed of, for example, a glass balloon, and having different diameters are mixed together with the same vitrified bond 24 as described above and a well-known binding agent such as dextrin. As a result, a coating composed of the vitrified bond 24 and the binding agent is formed on outer circumferential surfaces of the large-diameter inorganic hollow filler 22 and the small-diameter inorganic hollow filler 23 in a layered form and is dried according to need, whereby further fluidity is given.

The vitrified bond 24 is a glass powder excellent in high impact resistance and heat resistance, and is composed of, for example, glass frit having an oxide composition of 50 to 80% by weight of $SiO_2$, 10 to 20% by weight of $B_2O_3$, 5 to 15% by weight of $Al_2O_3$, 8 to 15% by weight of a total of metal oxides selected from CaO, MgO, $K_2O$, and $Na_2O$, or glass frit having an oxide composition of 70 to 90% by weight of $SiO_2$, 10 to 20% by weight of $B_2O_3$, 1 to 5% by weight of $Al_2O_3$, and 1 to 5% by weight of $Na_2O_3$, that is, powder glass fritted after melting.

The vitrified bond 24 may be such that gairome clay, etc., is added to the above powder glass. Further, the vitrified bond 24 is preferably rounded-off particles obtained by wet milling, and has 55% by volume or more of a single filling ratio when a molding pressure of 300 kg/mm$^2$ is applied, and has 1.2 or more of apparent density (bulk specific gravity) according to measurement based on a standard of ASTM D2840.

The CBN abrasive grains 20 have a grain size class in a range of, for example, #80 to #230 (#80/100 to #230/270 in the grain size class representation of A system using the mesh size of the classification method according to JIS (Japanese Industrial Standards) B 4130) and have a grain diameter, for example, whose average grain diameter is in a range of about 177 μm to 62 μm.

The large-diameter inorganic hollow filler 22 has an average particle diameter equal to, for example, the average grain diameter of the CBN abrasive grains 20, and in terms of the grain size class, an average particle diameter in a range from a grain size one class coarser to a grain size one class finer relative to the number indicating the grain size of the CBN abrasive grains 20. For example, when the grain size class of the CBN abrasive grains is #100/120, the large-diameter inorganic hollow filler 22 has a particle size in a range from the grain size class #80/100, which is one class coarser than that, to the grain size class #120/140, which is one class finer. On the contrary, the small-diameter inorganic hollow filler 23 has an average particle diameter in a range of 1/5 to 1/2 with respect to, for example, the average grain diameter of the CBN abrasive grains 20. These large-diameter inorganic hollow filler 22 and small-diameter inorganic hollow filler 23 are closed type hollow particles, for example, having an apparent density of 0.6 to 0.9 g/cm$^3$, a bulk density of 0.25 to 0.42 g/cm$^3$, a compression strength of 70 N/mm$^2$, a melting point of 1600° C. or higher, and a water absorption of almost zero.

The large-diameter inorganic hollow filler 22 and the small-diameter inorganic hollow filler 23 are prepared such that the filling volume with respect to the vitrified grinding stone 10 is 50% by volume or less and the total filling volume of the CBN abrasive grains 20, the large-diameter inorganic hollow filler 22, the small-diameter inorganic hollow filler 23, and the vitrified bond 24 is 75 to 90 parts by volume. The volume ratio between the large-diameter inorganic hollow filler 22 and the small-diameter inorganic hollow filler 23 is set in a range of 5:5 to 7:3. The concentration of the vitrified grinding stone 10 (a proportion of the CBN abrasive grains 20 in the vitrified bond 24=concentration/4) is in a range of 50 to 180.

Next, in a mixing process P3, the CBN abrasive grains 20 and the large-diameter inorganic hollow filler 22 and the small-diameter inorganic hollow filler 23 to which the foregoing corresponding coatings are applied are put into a mixer together with a well-known binding agent such as dextrin, for example, in a proportion in which the ratio of the CBN abrasive grains 20 to the filling agent particles (large-diameter inorganic hollow filler 22 and small-diameter inorganic hollow filler 23) becomes a preset particle number ratio in a range of 1:0.7 to 1:2, and mixed uniformly there.

Next, in a molding process P4, the foregoing mixed material is filled into a predetermined press die for forming a cylindrical molding space, and pressurized by a pressing machine to be molded. In a firing process P5, molded articles having undergone the molding process P4 are sintered under a firing condition that a temperature of, for example, about 900° C. is maintained for 0.5 hours in a predetermined firing furnace. This sintering burns off the binding agent and melts the vitrified bond 24 to form a molten glass body. Thus, as shown in the diagram of the structure of the vitrified grinding stone of FIG. 4, the CBN abrasive grains 20, the large-diameter inorganic hollow filler 22, and the small-diameter inorganic hollow filler 23 are mutually bonded via the melted vitrified bond 24 to forma segmented vitrified grinding stone, that is, segment grinding stones 16. Pores 26 naturally formed due to the absence of the binding agent (molding aid), etc., are shown among the CBN abrasive grains 20, the large-diameter inorganic hollow filler 22, the small-diameter inorganic hollow filler 23, and the vitrified bond 24 in FIG. 4.

Next, in a bonding process P6, the sintered segment grinding stones 16 are bonded in a state of being circumferentially arranged along an outer circumferential edge of the base metal 12. This bonding process P6 is not executed when the mixed material is molded in the cylindrical shape in the foregoing molding process P4 and the base metal is not used. Then, in a finishing process P7, the vitrified grinding stone 10 is manufactured by being ground or mechanically finished using a grinding tool so that outside dimensions such as the outer circumferential surface and the end surface meet a predetermined product specification. The vitrified grinding stone 10 is shipped through an inspection process P8.

Figure 4:
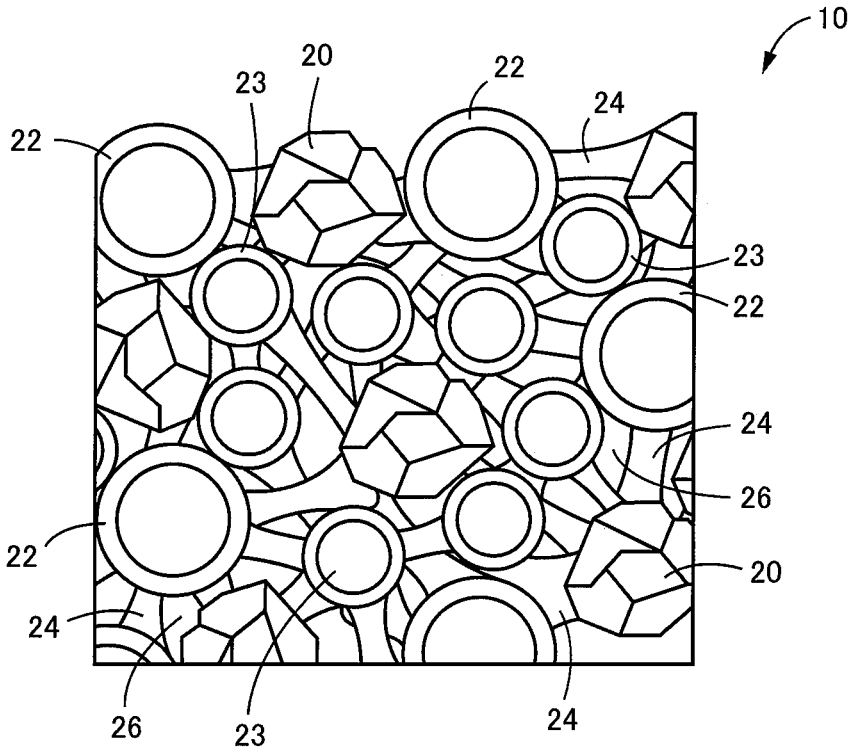
FIG. 4 is a schematic diagram for explaining a structure of the CBN vitrified grinding stone of FIG. 1 in an enlarged manner.

According to the vitrified grinding stone 10 provided with the grinding stone structure as shown in FIG. 4 by being manufactured as described above, the vitrified grinding stone structure in which the CBN abrasive grains 20 contribute relatively greatly to grinding performance and the large-diameter inorganic hollow filler 22 and small-diameter inorganic hollow filler 23 constituting the grinding stone structure together with the CBN abrasive grains 20 are bonded by the vitrified bond 24 while being filled in a predetermined space is formed. The CBN abrasive grains 20 and the large-diameter inorganic hollow filler 22 are made homogeneous by the interposition of the small-diameter inorganic hollow filler 23, and mutual agglomeration is suitably restricted and a relatively uniform distance is formed between the CBN abrasive grains 20, so that the occurrence of grinding burn is small and a long grinding stone life can be obtained.

The present inventors prepared Example product 1 corresponding to the vitrified grinding stone 10 and Comparative Example product 1 and Comparative Example product 2 using compositions shown below and using the same processes as those shown in FIG. 3 in order to confirm the effect of using two kinds of large-diameter inorganic hollow filler and small-diameter inorganic hollow filler having different diameters as the hollow inorganic filler in the segment grinding stones 16, conducted grinding tests using common grinding test conditions shown in FIG. 5, and carried out respective performance evaluations.

Comparative Example product 1 is a vitrified grinding stone (test product) in which a large-diameter inorganic hollow filler having a particle diameter equal to that of CBN abrasive grains was filled at a fixed amount. Comparative Example product is a vitrified grinding stone (test product) in which a small-diameter inorganic hollow filler 23 having an average particle diameter of ⅓ of that of CBN abrasive grains was filled at a fixed amount. Example product 1 is a vitrified grinding stone (test product) in which a large-diameter inorganic hollow filler 22 having a particle diameter equal to that of CBN abrasive grains and a small-diameter inorganic hollow filler having an average particle diameter of ⅓ of that of the CBN abrasive grains were filled at a volume ratio (that is, volume ratio) between the large-diameter inorganic hollow filler 22 and the small-diameter inorganic hollow filler 23 of 7:3 so that the total filling amount of the CBN abrasive grains, the inorganic bonding agent, and the hollow fillers was 86 parts by volume (86%). Example product 2 is a vitrified grinding stone (test product) in which a large-diameter inorganic hollow filler 22 having a particle diameter equal to that of CBN abrasive grains and a small-diameter inorganic hollow filler having an average particle diameter of ⅓ of that of the CBN abrasive grains were filled at a volume ratio between the large-diameter inorganic hollow filler 22 and the small-diameter inorganic hollow filler 23 of 7:3 so that the total filling amount of the CBN abrasive grains, the inorganic bonding agent, and the hollow fillers was 75 parts by volume. Example product 3 is a vitrified grinding stone (test product) in which a large-diameter inorganic hollow filler 22 having a particle diameter equal to that of CBN abrasive grains and a small-diameter inorganic hollow filler having an average particle diameter of ⅓ of that of the CBN abrasive grains were filled at a volume ratio between the large-diameter inorganic hollow filler 22 and the small-diameter inorganic hollow filler 23 of 5:5 so that the total filling amount of the CBN abrasive grains, the inorganic bonding agent, and the hollow fillers was 75 parts by volume. Example product 4 is a vitrified grinding stone (test product) in which a large-diameter inorganic hollow filler 22 having a particle diameter equal to that of CBN abrasive grains and a small-diameter inorganic hollow filler having an average particle diameter of ⅓ of that of the CBN abrasive grains were filled at a volume ratio between the large-diameter inorganic hollow filler 22 and the small-diameter inorganic hollow filler 23 of 5:5 so that the total filling amount of the CBN abrasive grains, the inorganic bonding agent, and the hollow fillers was 90 parts by volume.

Comparative Example Product 1

Concentration of grinding stone: 100
CBN abrasive grains #120: 25 parts by volume
Hollow filler #120: 21 parts by volume
Inorganic bonding agent: 24 parts by volume Comparative Example Product 2

Concentration of grinding stone: 100
CBN abrasive grains #120: 25 parts by volume
Hollow filler #230: 21 parts by volume
Inorganic bonding agent: 24 parts by volume Example Product 1

Concentration of grinding stone: 100
CBN abrasive grains #120: 25 parts by volume
Hollow filler #120: 26 parts by volume
Hollow filler #230: 11 parts by volume
Inorganic bonding agent: 24 parts by volume Example Product 2

Concentration of grinding stone: 100
CBN abrasive grains #120: 25 parts by volume
Hollow filler #120: 18 parts by volume
Hollow filler #230: 8 parts by volume
Inorganic bonding agent: 24 parts by volume Example Product 3

Concentration of grinding stone: 100
CBN abrasive grains #120: 25 parts by volume
Hollow filler #120: 13 parts by volume
Hollow filler #230: 13 parts by volume
Inorganic bonding agent: 24 parts by volume Example Product 4

Concentration of grinding stone: 100
CBN abrasive grains #120: 25 parts by volume
Hollow filler #120: 20.5 parts by volume
Hollow filler #230: 20.5 parts by volume
Inorganic bonding agent: 24 parts by volume FIG. 6 shows results of the foregoing grinding tests. "Power consumption" in FIG. 6 relates to the sharpness of the vitrified grinding stone, and Comparative Example product 1, Comparative Example product 2, and Example products 1 to 4 are not so different from one another. "Wheel corner sagging cross-sectional area" in FIG. 6 relates to the wear of the vitrified grinding stone. Example products 1 to 4 have half the wheel corner sagging cross-sectional area as compared to Comparative Example product 1 and Comparative Example product 2. "Depth of cut where grinding burn occurs" in FIG. 6 relates to the occurrence of workpiece burn. Smaller depth of cut indicates the ease of occurrence of grinding burn on the workpiece. Example products 1 to 4 have about half the ease of occurrence of grinding burn as compared to Comparative Example product 1 but have equal ease of occurrence of grinding burn as compared to Comparative Example product 2.

Further, the present inventors prepared Comparative Example product 3, Example product 5, and Example product 6 using compositions shown below and using the same processes as those shown in FIG. 3 in order to evaluate dispersibility of the CBN abrasive grains 20 in the grinding stone structure of the segment grinding stones 16 of the vitrified grinding stone 10, imaged cross-sectional images thereof with a digital microscope, calculated the area ratio of a solid matter in a white part in each of a plurality of divided (unit) areas in which binarized black-and-white cross-sectional images obtained from the cross-sectional images were divided, prepared a frequency distribution chart with a horizontal axis representing the size of the area ratio and a vertical axis representing the cumulative number of the divided areas, calculated the standard deviation of the frequency distribution chart as a value indicating the dispersion state, and conducted an evaluation test using the standard deviation. One side x of the divided area is, for example, a function of an average grain diameter D of the abrasive grains and an abrasive grain deposition rate Vg ($x=(500\ nD^2/4\ Vg)^{0.5}$).

The foregoing Comparative Example product 3 is a vitrified grinding stone (test product) in which a large-diameter inorganic hollow filler 22 having the same average particle diameter as CBN abrasive grains was filled at a fixed amount. Example product is a vitrified grinding stone (test product) in which a large-diameter inorganic hollow filler 22 having a particle diameter equal to that of CBN abrasive grains and a small-diameter inorganic hollow filler 23 having an average particle diameter of ⅕ of that of the CBN abrasive grains were filled at fixed ratios. Example product 6 is a vitrified grinding stone (test product) in which a large-diameter inorganic hollow filler 22 having a particle diameter equal to that of CBN abrasive grains and a small-diameter inorganic hollow filler 23 having an average particle diameter of ⅓ of that of the CBN abrasive grains were filled at fixed ratios.

Comparative Example Product 3

Concentration of grinding stone: 150
CBN abrasive grains #80: 37 parts by volume
Hollow filler #80: 26 parts by volume
Inorganic bonding agent: 18 parts by volume Example Product 5

Concentration of grinding stone: 150
CBN abrasive grains #80: 37 parts by volume
Hollow filler #80: 13 parts by volume
Hollow filler #400: 13 parts by volume
Inorganic bonding agent: 18 parts by volume Example Product 6

Figure 7:
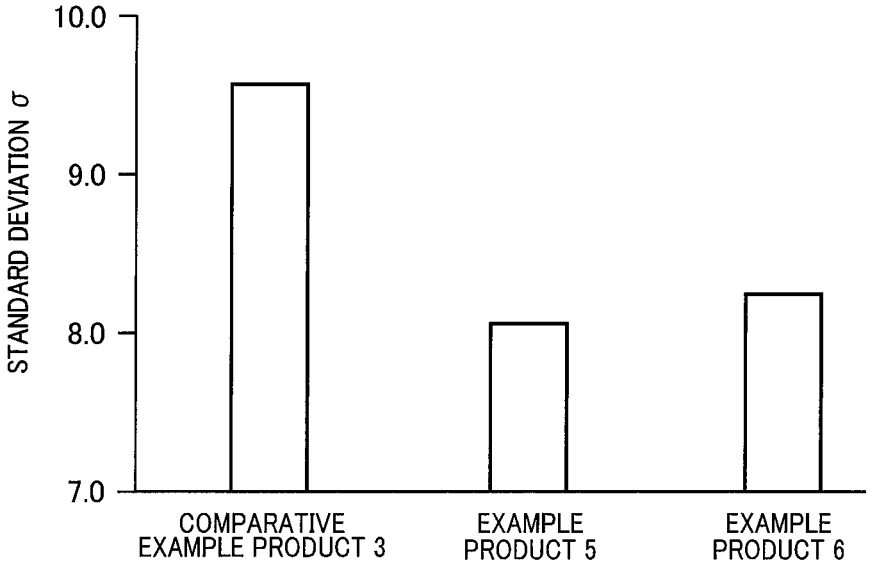
FIG. 7 is a drawing showing dispersion evaluation results of grinding stone structures in Comparative Example product 3, Example product 5, and Example product 6 by standard deviation G.

Concentration of grinding stone: 150
CBN abrasive grains #80: 37 parts by volume
Hollow filler #80: 13 parts by volume
Hollow filler #200: 13 parts by volume
Inorganic bonding agent: 18 parts by volume FIG. 7 shows dispersion evaluation results of grinding stone structures in the foregoing Comparative Example product 3, Example product 5, and Example product 6 by standard deviation σ. In FIG. 7, the standard deviation σ of Comparative Example product 3 was 9.6, whereas the standard deviation σ of Example product 5 was 8.0, and the standard deviation σ of Example product 6 was 8.2. It was shown that Example product 5 and Example product 6 had good dispersion of the grinding stone structure and were significantly homogeneous with respect to Comparative Example product 3.

As described above, according to the segment grinding stones 16 of the vitrified grinding stone 10 of the present embodiment corresponding to the high-porosity CBN vitrified grinding stone having the homogeneous structure, the CBN abrasive grain 20, the large-diameter inorganic hollow filler 22 having the average particle diameter in the range from the particle size one class coarser to the particle size one class finer with respect to the class indicating the grain size of the CBN abrasive grain 20, and the small-diameter inorganic hollow filler 23 having the average particle diameter of ⅕ to ½ of that of the CBN abrasive grain 20 are bonded by the vitrified bond (inorganic bonding agent) 24. Thus, the small-diameter inorganic hollow filler 23 is interposed between the CBN abrasive grain 20 and the large-diameter inorganic hollow filler 22, whereby the homogeneous grinding stone structure in which the CBN abrasive grains 20 and the large-diameter inorganic hollow filler 22 are uniformly dispersed is obtained. As a result, the distance between the CBN abrasive grains 20 becomes uniform, and local drop of the CBN abrasive grains 20 and work material burn are suitably suppressed even if the porosity is high, that is, the abrasive grain percentage is low. Further, the grinding stone strength and the grinding stone life can be obtained due to the homogeneous structure.

Further, according to the segment grinding stones 16 of the vitrified grinding stone 10 of the present embodiment, the total filling volume of the CBN abrasive grains 20, the vitrified bond (inorganic bonding agent) 24, the large-diameter inorganic hollow filler 22, and the small-diameter inorganic hollow filler 23 is 75 to 90 parts by volume when the segment grinding stones 16 are 100 parts by volume. As a result, the grinding stone strength of the segment grinding stones 16 is further enhanced.

Further, according to the segment grinding stones 16 of the vitrified grinding stone 10 of the present embodiment, the blending ratio, that is, the volume ratio, between the large-diameter inorganic hollow filler 22 and the small-diameter inorganic hollow filler 23 is in the range of 5:5 to 7:3. As a result, the CBN abrasive grains 20 and the large-diameter inorganic hollow filler 22 can be more uniformly dispersed.

Further, according to the segment grinding stones 16 of the vitrified grinding stone 10 of the present embodiment, homogeneity having a standard deviation of 8.5 or less in a frequency distribution chart of an abrasive grain area ratio which is a distribution chart of proportions of a solid matter including the CBN abrasive grain 20 per unit area at a plurality of locations in a cross section of the grinding stone is provided. As a result, a high-porosity CBN vitrified grinding stone having a homogeneous grinding stone structure can be obtained.

Although one embodiment of the present invention is described above with reference to the drawings, the present invention is also applied to other aspects of the present invention.

For example, in the foregoing embodiment, the CBN vitrified grinding stone 10 for surface grinding in which the segment grinding stones 16 are fixed on the outer circumferential surface of the disc-shaped metal base metal 12 has been described. However, the CBN vitrified grinding stone may be other forms of CBN vitrified grinding stones such as an integral grinding stone composed of a CBN vitrified grinding stone in its entirety, a CBN vitrified grinding stone for end surface grinding in which a plurality of segment grinding stones are annularly fixed along an outer circumferential edge of one surface of a disc-shaped metal base metal, a CBN vitrified grinding stone of a type in which a plurality of segment grinding stones are fixed on an annular end surface of a cup-shaped base metal, a CBN vitrified grinding stone of a type in which segment grinding stones are fixed on an outer circumferential surface of a base metal, or one in which a predetermined space is formed between segment grinding stones.

It should be noted that what has been described above is only an embodiment, and although other examples are not exemplified, the present invention can be practiced in a mode in which various modifications and improvements are added based on the knowledge of those skilled in the art without departing from the gist of the present invention.

REFERENCE SIGNS LIST

10: vitrified grinding stone (CBN vitrified grinding stone)
12: base metal
16: segment grinding stones (CBN vitrified grinding stone)
20: CBN abrasive grains
22: large-diameter inorganic hollow filler
23: small-diameter inorganic hollow filler
24: vitrified bond (inorganic bonding agent)
26: pores

What is claimed is:

1. A high-porosity CBN vitrified grinding stone having a homogeneous structure, the grinding stone comprised of a CBN abrasive grain, a large-diameter inorganic hollow filler having an average particle diameter in a range from a grain size one class coarser to a grain size one class finer with respect to a class indicating a grain size of the CBN abrasive grain, and a small-diameter inorganic hollow filler having an average particle diameter of ⅕ to ½ of that of the CBN abrasive grain, the CBN abrasive grain, the large-diameter inorganic hollow filler, and the small-diameter inorganic hollow filler being bonded by an inorganic bonding agent.

2. The high-porosity CBN vitrified grinding stone having the homogeneous structure according to claim 1, wherein a total filling volume of the CBN abrasive grain, the inorganic bonding agent, the large-diameter inorganic hollow filler, and the small-diameter inorganic hollow filler is 75 to 90 parts by volume when the high-porosity CBN vitrified grinding stone is 100 parts by volume.

3. The high-porosity CBN vitrified grinding stone having the homogeneous structure according to claim 1, wherein a volume ratio between the large-diameter inorganic hollow filler and the small-diameter inorganic hollow filler is in a range of 5:5 to 7:3.

4. The high-porosity CBN vitrified grinding stone having the homogeneous structure according to claim 1, wherein homogeneity having a standard deviation of 8.5 or less in a frequency distribution chart of an abrasive grain area ratio which is a distribution chart of proportions of a solid matter including the CBN abrasive grain per unit area at a plurality of locations in a cross section of the grinding stone is provided.

* * * * *